US008297057B2

(12) United States Patent
Toon

(10) Patent No.: US 8,297,057 B2
(45) Date of Patent: Oct. 30, 2012

(54) FUEL INJECTOR

(75) Inventor: Ian J. Toon, Leicester (GB)

(73) Assignee: Rolls-Royce, PLC, London (GB)

( * ) Notice: Subject to any disclaimer, the term of this patent is extended or adjusted under 35 U.S.C. 154(b) by 602 days.

(21) Appl. No.: 12/314,177

(22) Filed: Dec. 5, 2008

(65) Prior Publication Data

US 2009/0173076 A1 Jul. 9, 2009

(30) Foreign Application Priority Data

Jan. 3, 2008 (GB) ..... 0800064.8

(51) Int. Cl.
*F02C 1/00* (2006.01)

(52) U.S. Cl. ..... 60/746; 60/748

(58) Field of Classification Search ..... 60/740, 60/742, 746–748, 737
See application file for complete search history.

(56) References Cited

U.S. PATENT DOCUMENTS

| | | | | |
|---|---|---|---|---|
| 3,570,242 | A * | 3/1971 | Leonardi et al. | 60/737 |
| 4,455,839 | A * | 6/1984 | Wuchter | 60/737 |
| 6,418,726 | B1 | 7/2002 | Foust et al. | |
| 7,434,401 | B2 * | 10/2008 | Hayashi | 60/743 |
| 7,878,000 | B2 * | 2/2011 | Mancini et al. | 60/740 |
| 7,942,003 | B2 * | 5/2011 | Baudoin et al. | 60/748 |
| 2007/0028617 | A1 * | 2/2007 | Hsieh et al. | 60/737 |

FOREIGN PATENT DOCUMENTS

EP 1 672 282 A1 6/2006

* cited by examiner

*Primary Examiner* — Phutthiwat Wongwian
(74) *Attorney, Agent, or Firm* — Oliff & Berridge, PLC

(57) ABSTRACT

A fuel injector head for a gas turbine engine the head having a pilot injector and a main injector located radially outwardly of the pilot injector. A concentric splitter separates the pilot injector from the main injector and has a toroid chamber which is supplied with air in use to generate a toroidal flow which delays mixing of the pilot and main air flows.

14 Claims, 3 Drawing Sheets

FUEL INJECTOR

BACKGROUND

This invention concerns fuel injector assemblies for gas turbine engines.

There is a continuing need, driven by environmental concerns and governmental regulations, for improving the efficiency of and decreasing the emissions from gas turbine engines of the type utilised to power jet aircraft, marine vessels or generate electricity. Particularly there is a continuing drive to reduce nitrous oxide ($NO_x$) emissions.

Advanced gas turbine combustors must meet these requirements for lower NO emissions under conditions in which the control of NO generation is very challenging. For example, the goal for the Ultra Efficient Engine Technology (UEET) gas turbine combustor research being done by NASA is a 70 percent reduction in NO emissions and a 15 percent improvement in fuel efficiency compared to ICAO 1996 standards technology. Realisation of the fuel efficiency objectives will require an overall cycle pressure ratio as high as 60 to 1 and a peak cycle temperature of 1600° C. or greater. The severe combustor pressure and temperature conditions required for improved fuel efficiency make the $NO_x$ emissions goal much more difficult to achieve.

Conventional fuel injectors that seek to address this issue have concentrically arranged pilot and main injectors with the main injector surrounding the pilot injector. However, conventional injector arrangements have several operational disadvantages, including for example, flame stability and relight characteristics, the potential for excessive combustor dynamics or pressure fluctuations caused by combustor instability. Combustion instability occurs when the heat release couples with combustor acoustics such that random pressure perturbations in the combustor are amplified into larger pressure oscillations. These large pressure oscillations, having amplitudes of about 1-5% of the combustor pressure, can have catastrophic consequences and thus must be reduced or eliminated.

The invention seeks to provide an improved injector that addresses these and other problems.

SUMMARY

According to a first aspect of the present invention there is provided a fuel injector assembly for a gas turbine engine the assembly including: a pilot injector having a central axis, a main injector located radially outwardly of the pilot injector, a concentric splitter separating the pilot injector from the main injector and bounding a volume through which in use a fuel injected by the pilot injector flows; characterised in that the splitter has a toroid chamber which is supplied with air in use to generate a toroidal flow.

Beneficially, the flow within the toroid chamber forms a cooling air film over the surface which helps to prevent high temperature damage to the splitter.

Preferably the pilot injector includes an annular pilot fuel housing concentric with the central axis, the inner surface of the fuel housing providing a prefilmer surface for the supply of fuel thereto in the form of a film extending to a prefilmer lip wherein the inner surface defines a bore for the supply of air over the prefilmer.

The pilot injector may include an annular outer bore concentric with the central axis for the supply of air over the prefilmer lip.

The radially inner surface of the splitter may provide the radially outer wall of the annular outer bore.

Preferably the splitter includes an end surface adapted to face the combustion chamber, the toroid chamber being at least partly defined by the end surface.

The concentric splitter may have a radially outer wall and a cavity between the radially outer wall and the radially inner surface.

An aperture may extend from the cavity to the toroid chamber to supply the air. The aperture may extend from main fuel injector to the toroid chamber to supply the air.

Preferably the toroid chamber is an annular channel concentric about the pilot injector.

BRIEF DESCRIPTION OF THE DRAWINGS

Embodiments of the present invention will now be described by way of example only and with reference to the accompanying drawings, in which:—

DETAILED DESCRIPTION OF EMBODIMENTS

Figure 1:
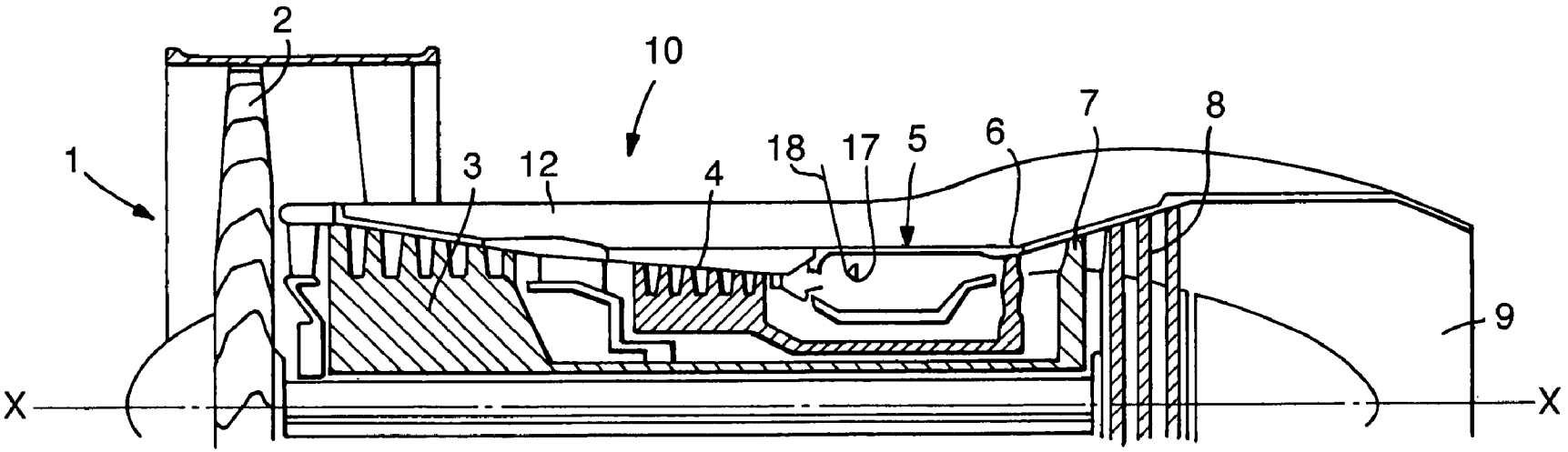
FIG. 1 depicts a general gas turbine engine section.

With reference to FIG. 1, a ducted fan gas turbine engine generally indicated at 10 includes, in axial flow series, an air intake 1, a propulsive fan 2, an intermediate pressure compressor 3, a high pressure compressor 4, combustion equipment 5, a high pressure turbine 6, an intermediate pressure turbine 7, a low pressure turbine 8 and an exhaust nozzle 9.

Air entering the air intake 1 is accelerated by the fan 2 to produce two air flows, a first air flow into the intermediate pressure compressor 3 and a second air flow that passes over the outer surface of the engine casing 12 and which provides propulsive thrust. The intermediate pressure compressor 3 compresses the air flow directed into it before delivering the air to the high pressure compressor 4 where further compression takes place.

Compressed air exhausted from the high pressure compressor 4 is directed into the combustion equipment 5, where it is mixed with fuel injected through a fuel injector 17 mounted on an injector stalk 18 and the mixture combusted. The resultant hot combustion products expand through and thereby drive the high 6, intermediate 7 and low pressure 8 turbines before being exhausted through the nozzle 9 to provide additional propulsive thrust. The high, intermediate and low pressure turbines respectively drive the high and intermediate pressure compressors and the fan by suitable interconnecting shafts.

Figure 2:
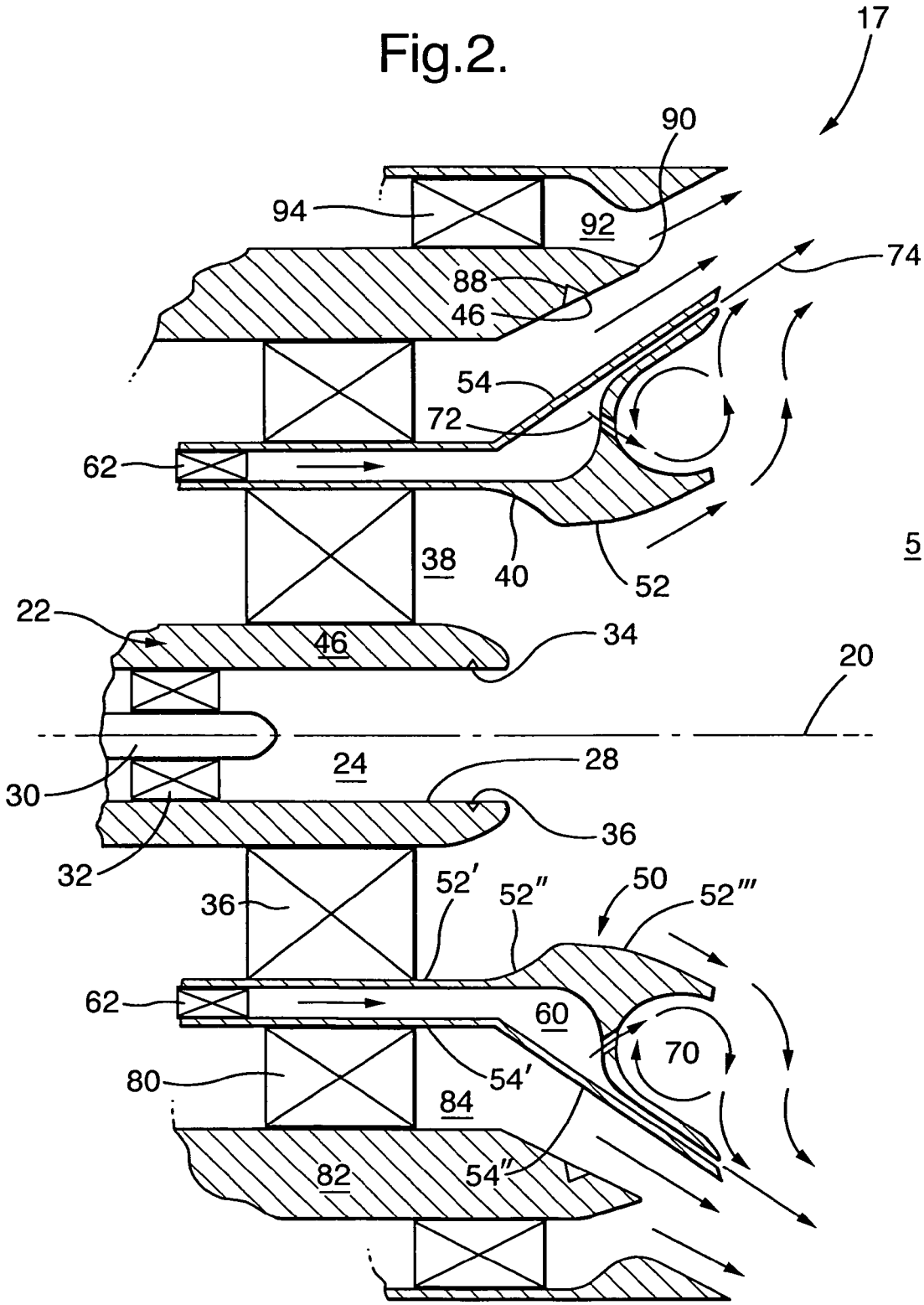
FIG. 2 depicts an embodiment of an injector in accordance with the invention.

FIG. 2 shows a concentrically staged injector 17 in accordance with the invention. The injector has a central axis 20 that extends generally parallel with the main axis, X-X of FIG. 1, of the engine.

A pilot injector 22 is arranged around the axis 20 to inject fuel primarily at low power usage but also some fuel, along with the main injector, at higher power usage. The injector in this embodiment is an airblast injector having a bore 24 defined by a fuel housing 26 the inner surface of which provides a prefilmer surface 28 to which fuel is supplied from passages within the fuel housing.

A centrebody 30 in the bore 24 supports an array of axial swirl vanes 32 that impart swirl to a flow of air through the bore 24 and over the prefilmer surface 28. The air flow is accelerated by the swirl vanes and the imparted tangential momentum directs the flow over the prefilmer such that there is no separation of the boundary layer. The fuel supplied to the prefilmer 28 by slots 34 is accelerated by the swirling air flow and carried as a film to the prefilmer lip 36 at the downstream end of the bore 24, where it is atomised within swirling air from a separate flow of air within an outer swirl passage 38.

The fuel housing 26 provides separation between the bore 24 and the outer swirl passage 38 and provides the outer surface of the bore 24 and the inner surface of the outer swirl passage 38. Fuel passages (not shown) in the fuel housing have swirl vanes to impart a swirling motion to the fuel before it is supplied to the prefilmer 28. Beneficially, the fuel is provided to the surface 28 with a uniform distribution.

The outer swirler passage 38 is provided with an elbow 40 that gives a strong area contraction to increase the peak velocity of the air flow. The generated high velocity, swirling flow interacts with the atomised fuel to produce a well dispersed fuel and air mixture.

The pilot injector must provide a stable flame throughout the operating range of the combustor. Stability can be improved by operating the injector in a rich mode i.e. more fuel than stoichiometrically required. However, operating the combustion rich can give rise to the generation of smoke and unburned hydrocarbons as well as excessive fuel usage. Operating the combustion lean can result in too much air and problems of weak extinction. Typically 8% of combustor air passes through the pilot injector.

Airspray pilot injectors offer advantages over simple pressure-jet injectors. For example, they generally give less smoke at high pressures than a pressure jet and also offer improved ignition during re-light because of more uniform atomisation. It will be appreciated that the airspray pilot could be substituted by a pressure jet atomiser injector or another appropriate type.

The flame produced by the pilot injector is protected from a main injector air flow by a splitter 50. The splitter has a radially inner surface 52 and a radially outer surface 54. The radially inner surface is profiled to provide a columnar portion 52', a converging portion 52" that converges to a throat and a diverging portion 52'". The shape of the inner surface diverging portion from the throat is profiled to match the trajectory of the swirling air-flow through the swirler passage 38 to ensure the airflow remains attached to the wall at high velocity to cool the splitter and create a stable aerodynamic flow. The end of the splitter forms a lip, which directs the airflow and helps its entrainment into an airflow pattern created by a splitter end profile. The radially outer surface 54 is also profiled to provide a columnar portion 54' that extends to an elbow and a radially outwardly extending outboard cone 54" that directs main injection air away from the pilot combustion zone.

The splitter 50 is substantially hollow and can have, at its upstream end, a device which controls the flow of cooling air into an internal chamber 60 if this is deemed necessary. At the downstream end of the chamber the air flow is vented towards the combustion chamber in at least two flows.

The downstream end of the splitter is profiled to generate a toroidal flow which helps to delay mixing of the pilot and main airflows and directs the pilot airflow downstream. The toroidal flow pattern is a stable aerodynamic flow field, unlike vortices which may be shed from a bluff end face of a splitter. The shed vortices can lead to unstable main flame heat release creating fluctuating pressures which can excite and damage combustor components. The intermittent ignition of the main by the primary flow can also result in a reduced heat release and hence reduced combustor efficiency.

The toroidal flow generated by the downstream end wall of the splitter is generated primarily by airflow over the profile of this endwall. In the embodiment of FIG. 2 the profile is of an annular channel 70 facing towards the combustion chamber 5. The toroidal flow is induced and/or reinforced by a flow of air 72 from the splitter cavity 60 into the toroidal flow chamber through an aperture having an axis that extends substantially secantially from the splitter cavity 60 to the toroidal flow chamber to supply the air. Other shapes of end wall may be used to create the toroidal flow.

As the toroidal flow chamber faces the combustion chamber 5 it is liable to get hot. The flow 72 of relatively cool air which serves to promote the toroidal flow helps, in part, to cool the combustion chamber facing walls of the toroid flow chamber. The rearward wall of the toroid chamber is cooled by a further flow of air from the splitter chamber 60. This flow 74 passes through an annular passage between the radially outer wall 54 of the splitter and the wall of the toroid chamber and is exhausted into the combustion chamber. Beneficially, the flow 74 creates a low static pressure as it exits the annular passage, the low static pressure entraining the pilot airflow and further reinforcing the stable toroidal airflow in the toroid chamber 70.

The main injector is located radially outside the pilot injector. The main injector has a radially inner swirl passage 84 defined between the radially outer surface 54 of the splitter and the radially inner surface of the main fuel housing 82. The inner main swirl passage 84 has an array of inner swirl vanes 80 that swirls the main flow of air. Approximately 50% of combustor air passes through the inner swirl passage 84.

The fuel housing 82 defines a prefilmer 46 and supports a fuel supply that opens into an annular swirl slot 88 in the prefilmer face. Fuel is supplied as a film to the prefilmer and remains as a film to the prefilmer lip 90 where it is atomised in the swirling air flow. An outer swirl passage 92 is located radially outside the fuel housing 82 and an array of swirlers 94 generate swirling flow that mixes with the atomised fuel to create a highly dispersed air and fuel mixture.

The main injector provides fuel to the combustor at high power loadings with the fuel being ignited by the pilot flame. It is desirable to control the manner in which the pilot flame and the main combustion zone interact. The toroidal airflow creates a stable flame anchoring zone when the primary fuel is mixed with it, thus supplementing the usual anchoring effected by the combustion gas flow pattern which recirculates around the fuel supply nozzle centreline.

The single toroidal airflow on the splitter end profile creates a stable flow field from the fuel supply nozzle, hence preventing unstable combustion heat release and the resultant fluctuating pressure which can excite and damage combustor components.

Figure 3:
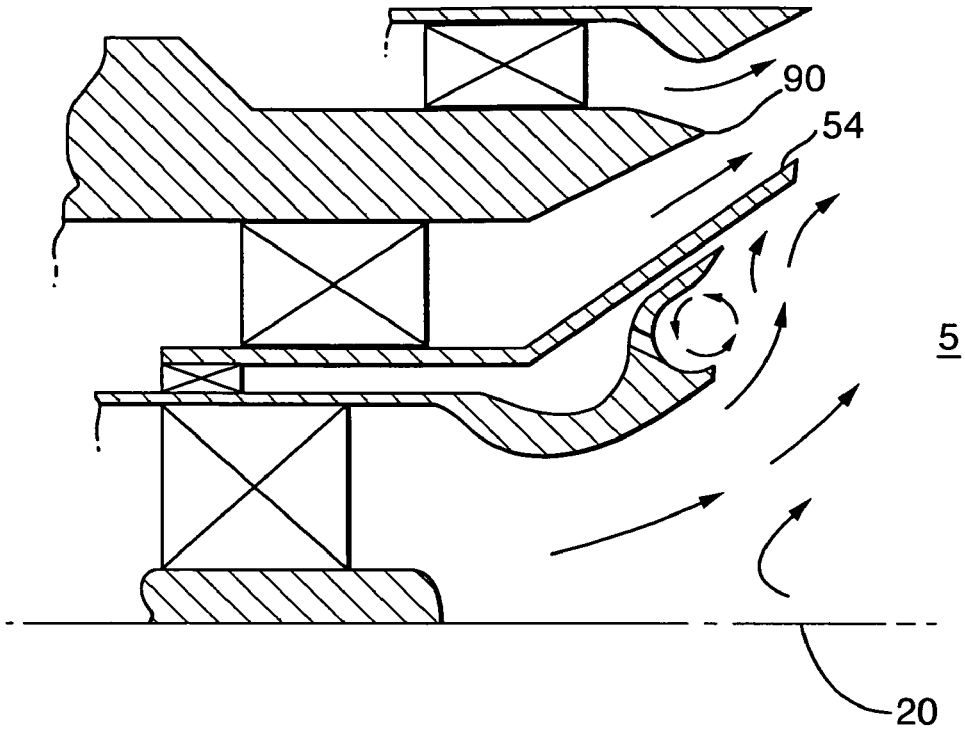
FIG. 3 depicts another embodiment of the injector.

Various modifications may be made without departing from the scope of the invention. For example, FIG. 3 depicts an injector modified by providing a shortened toroid chamber radially outer surface. A cooling film is ejected between the outboard cone 54 and the toroid chamber to create a film of air on the radially inner surface of the outboard cone 54. The film serves to cool the outboard cone and reduces the level of cooling required for the toroid chamber.

Figure 4:
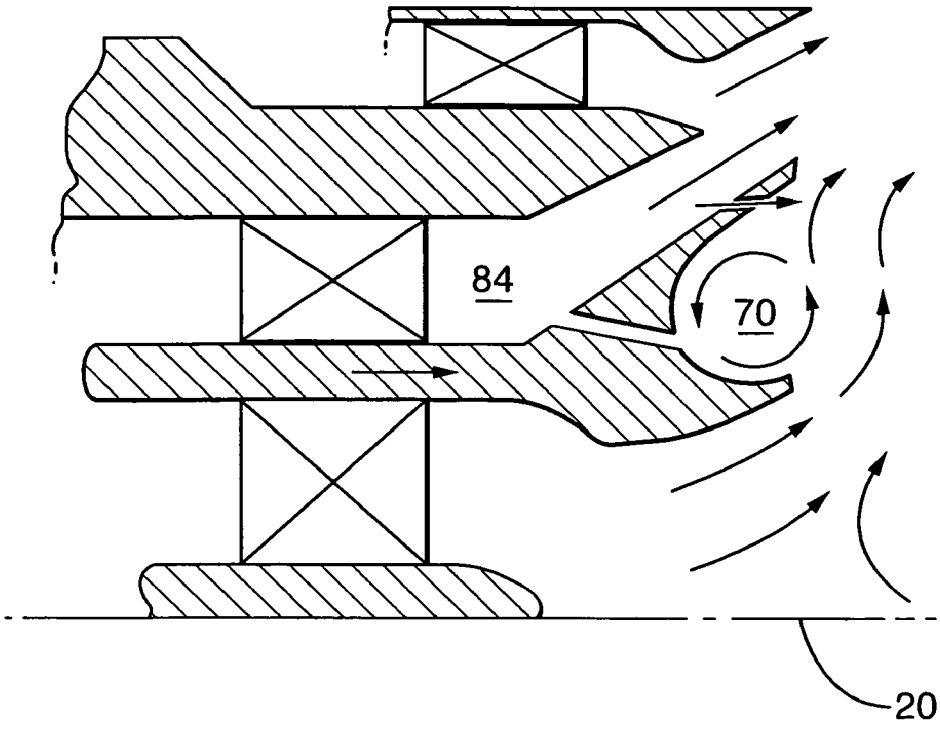
FIG. 4 depicts a further embodiment of the injector.

In the next embodiment, as shown in FIG. 4, the splitter is modified such that air is supplied to the toroid chamber 70 from the inner mains air duct 84 rather than from the internal splitter chamber 60.

I claim:

1. A fuel injector assembly for a gas turbine engine the assembly comprising:

a pilot injector having a central axis;

a main injector located radially outwardly of the pilot injector;

a concentric splitter separating the pilot injector from the main injector and bounding a volume through which in use a fuel injected by the pilot injector flows, the concentric splitter having a cavity, wherein the splitter has a toroid chamber that is supplied with air in use to generate a toroidal flow, the toroid chamber having an axially rearward surface through which air is supplied to the toroid chamber and an open axially forward surface, and an aperture that supplies the air and has an axis that extends substantially secantially from the cavity to the toroid chamber.

2. A fuel injector head according to claim 1, wherein the pilot injector comprises an annular pilot fuel housing having an inner surface and being concentric with the central axis, the inner surface of the fuel housing defining a prefilmer surface for the supply of fuel thereto in the form of a film extending to a prefilmer lip, wherein the inner surface defines a bore for the supply of air over the prefilmer.

3. A fuel injector assembly according to claim 1, wherein the pilot injector comprises a nozzle located at the central axis for ejecting fuel into the volume.

4. A fuel injector head according to claim 1, wherein the pilot injector comprises an annular outer bore concentric with the central axis for the supply of air into the volume.

5. A fuel injector according to claim 4, wherein the splitter has a radially inner surface that defines the radially outer wall of the annular outer bore.

6. A fuel injector according to of claim 1, wherein the concentric splitter has a radially outer wall, wherein the radially outer wall and the radially inner surface define the cavity.

7. A gas turbine engine incorporating the fuel injector assembly according to claim 1.

8. A fuel injector according to claim 1, wherein the aperture has an inlet and an outlet, and the inlet extends from the cavity and the outlet extends from the toroid chamber.

9. A combustor of a gas turbine engine incorporating the fuel injector assembly according to claim 1.

10. A combustor according to claim 9, wherein the combustor defines a combustion volume with the open axially forward surface bounding a portion of the combustion volume.

11. A combustor according to claim 10, wherein the toroid chamber has a circulating flow of air, the air at the axially rearward surface moving in a direction towards the axis and the air at the axially forward open surface moving radially away from the axis.

12. A combustor according to claim 11, wherein the air at the axially forward open surface sheds to the combustion volume.

13. An annular combustor of a gas turbine engine comprising a fuel injector assembly, the fuel injector assembly further comprising:

a pilot injector having a central axis;

a main injector located radially outwardly of the pilot injector;

a concentric splitter separating the pilot injector from the main injector and bounding a volume through which in use a fuel injected by the pilot injector flows, wherein the splitter has a toroid chamber that is supplied with air in use to generate a toroidal flow, the toroid chamber having an axially rearward surface through which air is supplied to the toroid chamber and an open axially forward surface, the annular combustor defines a combustion volume with the open axially forward surface bounding a portion of the combustion volume, the toroid chamber has a circulating flow of air, the air at the axially rearward surface moving in a direction towards the axis and the air at the axially forward open surface moving radially away from the axis, and the air at the axially forward open surface sheds to the combustion volume.

14. A combustor according to claim 12, wherein the combustor is an annular combustor.

* * * * *